United States Patent [19]

Li

[11] 4,320,539

[45] Mar. 23, 1982

[54] DRAIN CLEARING DEVICE

[76] Inventor: Steven S. Li, 33 Essex St., New York, N.Y. 10002

[21] Appl. No.: 232,976

[22] Filed: Feb. 9, 1981

[51] Int. Cl.[3] ..... E03D 11/00

[52] U.S. Cl. ..... 4/256; 4/255; 4/257

[58] Field of Search ..... 4/255, 256, 257; 134/167 C, 24, 166 C; 15/406, 104.05

[56] References Cited

U.S. PATENT DOCUMENTS

| | | | |
|---|---|---|---|
| 895,955 | 8/1908 | Brown | 4/256 |
| 1,314,261 | 8/1919 | Griesche | 4/256 |
| 1,558,161 | 10/1925 | Gunderson | 4/256 |
| 1,734,206 | 11/1929 | Fisch | 4/255 X |
| 2,086,149 | 7/1937 | Allen | 4/256 |
| 2,336,592 | 12/1943 | Brown | 4/256 |
| 3,644,943 | 2/1972 | Leonardo et al. | 4/255 |
| 4,144,598 | 3/1979 | Li | 4/256 |

FOREIGN PATENT DOCUMENTS 893201 2/1972 Canada .

*Primary Examiner*—Henry K. Artis
*Attorney, Agent, or Firm*—Kenyon & Kenyon

[57] ABSTRACT

A drain clearing device which effectively employs water pressure to clear a blocked drain where the drain opening is submerged or relatively inaccessible. The drain clearing device comprises a drain sealing member of resiliently compressible material attached to a water supply device having an elongated pipe with a side arm for coupling to a water hose. A plunger valve is mounted in an end of the pipe remote from the sealing member and when activated allows water pressure to clear the blocked drain.

7 Claims, 2 Drawing Figures

DRAIN CLEARING DEVICE

This invention relates to a drain clearing device. More particularly, this invention relates to a drain clearing device for drains having an opening which is submerged or relatively inaccessible.

BACKGROUND OF THE INVENTION

Heretofore, various drain clearing techniques have been known for clearing clogged basins in drainage systems such as in a sink or toilet. For example use has been made of chemical compositions and mechanical devices, such as plungers, elongated wires commonly known as snakes, and the like. However, chemical compositions are generally only effective against certain types of drain clogging materials and tend to cause corrosion or damage to the drainage system when used frequently. Mechanical devices, such as plungers, are frequently not effective for badly blocked drains and snakes are relatively difficult to use, and frequently necessitate professional assistance. Other mechanical devices have also been known, such as described in U.S. Pat. No. 4,144,598, which have a drain blocking member connected to a plunger and a water supply device in a plastic housing. However, in use, the device must be held by hand or a supporting rod. As a result, such a device is relatively difficult to use in clearing drains where the drain opening is submerged or relatively inaccessible, as the supporting rod tends to slip and an effective seal cannot be readily maintained. Further, if used by hand, the result may well be most unpleasant to the user, particularly where the drain water is dirty.

OBJECTS OF THE INVENTION

Accordingly, it is an object of the invention to provide a relatively simple and effective device for clearing drains.

It is another object of the invention to provide a drain clearing device which can be manipulated from a position remote from a drain to be cleared, so that the user would not have to be in contact with dirty drain water.

It is another object of the invention to provide a drain clearing device which is not corrosive to a drainage system.

It is a further object of the invention to provide a drain clearing device which is simple and economical to manufacture.

SUMMARY OF THE INVENTION

Briefly, the invention provides a drain clearing device which includes a sealing member for sealing a drain opening and having a passage extending therethrough, and a water supply device having an elongated pipe secured to the sealing member coaxially of the passage, a side arm extending from and communicating with the pipe at a point remote from the sealing member to supply water to the pipe and a plunger valve in the pipe at an end remote from the sealing member to selectively communicate the side arm with the pipe for passage of a pressurized flow of water from the side arm into the pipe.

The sealing member is made of a resiliently compressible material so as to seal against and around a drain opening and may be backed by a solid annular member.

The side arm is connectable via a water hose or the like to a source of water pressure, such as a faucet of a household water supply system in order to receive and deliver a flow of pressurized water into the pipe.

The plunger valve comprises a hollow stem with a port, a knob and a spring around the stem. The stem is slidably mounted in the pipe so that in an extended position the stem blocks the side arm from the pipe so that water cannot flow into the pipe whereas in a depressed position, the stem aligns the port with the side arm so that water can flow into the pipe and thus into the drain. The knob is placed at one end of the stem to abut against the end of the pipe and prevent the stem from passing completely into the pipe. The spring is placed around the stem in abutment with the pipe for urging the stem out of the pipe to the extended position.

The plunger valve is activated when pressure is applied downward on the knob to push the valve stem from the extended position to the depressed position where the port is in communication with the side arm on the pipe.

In use, in order to clear a clogged drain, the drain clearing device is connected to a suitably located water faucet by a water hose, for example, via threaded couplings. The sealing member of the drain clearing device is then positioned in place via the elongated pipe and held firmly against the drain opening to create a seal. The water faucet is then turned on and the plunger valve activated by a downward push on the knob. Water from the faucet thus flows through the side arm, the pipe and through the drain sealing member into the drain. The pressure of the water is thus utilized to dislodge drain clogging materials.

BRIEF DESCRIPTION OF THE DRAWINGS

Referring to FIG. 1 the drain clearing device comprises a semi-spherical drain sealing member 1 and a water supply device 5.

Figure 2:
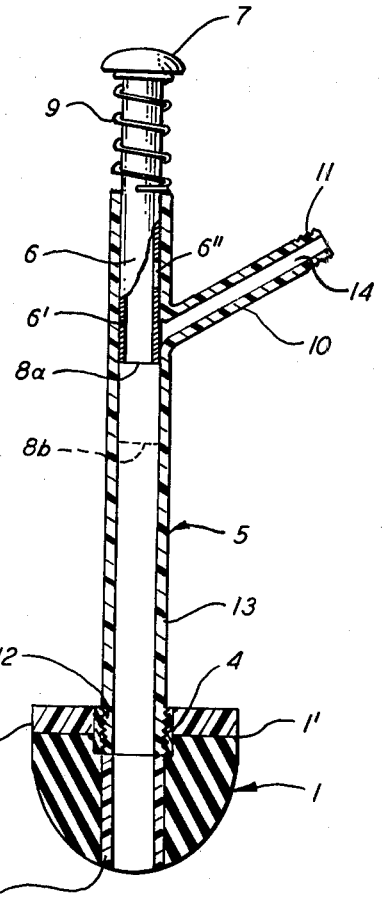
FIG. 2 illustrates a cross-sectional view of the drain clearing device in accordance with the invention.

The drain sealing member 1 is made of a resiliently compressible material, such as rubber, and is adapted to seal against a drain opening 21 which is submerged under level of water 23, for example in a toilet bowl 22. The drain sealing member 1 can be made in different sizes for different drain openings and, as shown in FIG. 2, has a planar base 1', and a central passage for a through flow of water. The drain sealing member 1 is fixedly attached to a round, solid, disc-like, annular member 2, made of a hard material, such as plastic or metal which provides a firm backing for the sealing member 1. In addition, a tube 3 with a cup-shaped internally threaded part 4 extends through the center of the sealing member 1 and annular member 2.

The water supply device 5 is removably mounted in the sealing member 1 and comprises an elongated pipe 13 made of pressure resistant material, such as plastic or metal, with a side arm 10 and a plunger valve 6 mounted at one end of the pipe 13.

The pipe 13 is externally threaded at one end 12 and threads into the threaded part 4 in the sealing member 1 and is coaxial with the passage formed by the tube 3 in the sealing member.

The side arm 10 is integral with the pipe 13 and has a passageway 14 which communicates with the interior of the pipe 13. As shown, the side arm 10 extends at an upward angle from the pipe 13 for a short distance and has a threaded end 11. The plunger valve 6 is mounted in the end of the pipe 13 remote from the sealing member 1 and serves to selectively communicate the side arm 10 with the pipe 13. As shown in FIG. 2, the valve 6 includes a stem 6' with a port 6'', a knob 7 and a spring 9. The stem 6' is slidably mounted in the pipe 13 to move from an upper extended position 8*a* to a lower depressed position 8*b* under a manually applied force on the knob 7. In this lower position, the port 6'' is aligned with the side arm 10 so as to communicate the passage 14 in the side arm 10 with the pipe 13. The knob 7 is at the upper end of the stem 6' and abuts the end of pipe 13 to prevent the stem 6' from passing completely into the pipe 13. The spring 9 is positioned around the plunger stem 6' and abuts the end of the pipe 13 for return of the stem 6' from the lower position 8*b* to the upper position 8*a* when pressure is released from the knob 7.

Figure 1:
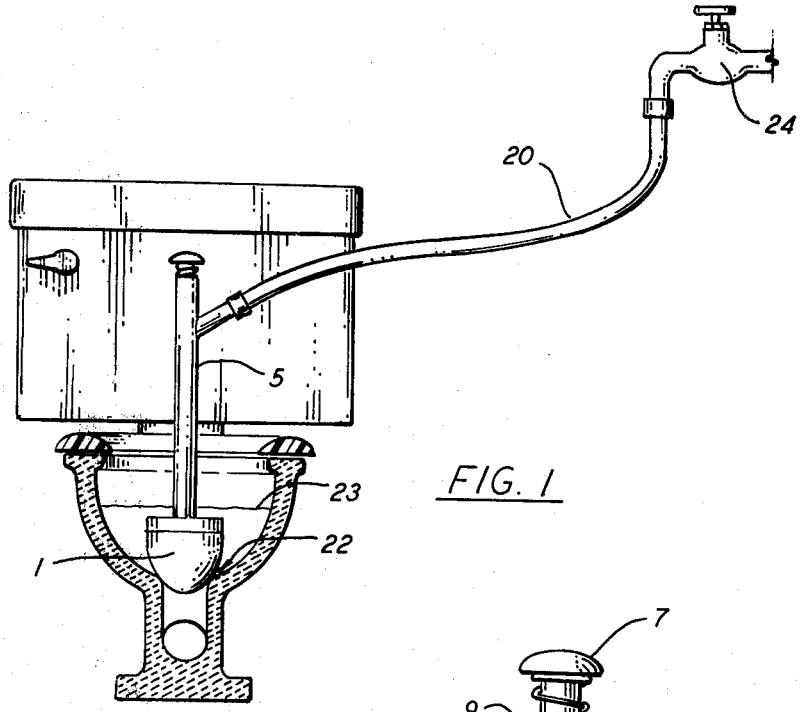
FIG. 1 illustrates a schematic view of a drain clearing device in a position for use in accordance with the invention.

Referring to FIG. 1, when used, the side arm 10 of the device is coupled to a conventional water faucet by the use of a water hose 20 via a threaded coupling at both ends of the water hose 20. The drain sealing member 10 is then held firmly over the clogged drain opening 21 to create a seal. The faucet is then turned on and the plunger valve is activated by pushing knob 7 downward. At this time, the water passes through the hose 20 and side arm 10 into the pipe 13 and downwardly through the central passage of the sealing member 1 into the drain. The pressure of the water from the faucet 24 is thus transmitted into the drain to clear the drain which may be clogged by materials such as hair, grease, paper, gauze and the like. The pressure applied downward by pressing knob 7 also helps to maintain a seal around the drain sealing member 1 and the drain opening.

The pipe 13 and side arm 10 are made of a material which is sufficiently rigid to withstand the forces involved, and is of sufficient thickness to withstand water pressure during use. The pipe 13 should also be of sufficient length to keep the user's hand above the drain water level of the submerged drain.

The material used to make drain sealing member 1 is also of sufficient resiliency such that when pressed against the drain opening, an effective seal will be maintained.

The invention thus provides a device which is simple in structure, easy to use and manufacture and effective for use in any kind of drains as are used in sinks, toilets and the like. In addition, it is effective for use in clearing drains where the drain opening is relatively inaccessible and the user is kept away from any dirty water which may be present.

What is claimed is:

1. A drain clearing device comprising:

a drain sealing member with a central passage for sealing against a drain opening; and a water supply device having an elongated pipe secured to said sealing member and communicating with said central passage in said sealing member, a side arm extending from an end of said pipe remote from said sealing member and communicating with said pipe for supplying water thereto, and a plunger valve having a hollow stem mounted in an end of said pipe remote from said sealing member and having a port in a wall thereof for selective alignment with said side arm, a knob at an end of said stem, and a spring positioned around said stem in abutment with said pipe for urging said stem out of said pipe.

2. A drain clearing device comprising:

a semi-spherical drain sealing member with a central passage to allow through flow of water, said member being made of resiliently compressible material for sealing a drain opening; and a water supply device having:

an elongated pipe secured to said sealing member and communicating with said central passage of said sealing member;

a side arm integral with an communicating with said pipe and extending from an end of said pipe remote from said sealing member for supplying water to said pipe; and a plunger valve movably mounted in an end of said pipe remote from said sealing member for selectively communicating said side arm with said pipe to permit a flow of water from said side arm into said pipe, said plunger valve having a hollow stem with a port in said stem for alignment with said side arm, a knob fixedly attached at one end of said stem outside of said pipe for the application of downward pressure to depress stem into said pipe to align said port with said side arm and a spring positioned around said stem outside and abutting against said pipe for urging said stem out of said pipe.

3. A drain clearing device comprising:

a semi-spherical drain sealing member of resiliently compressible material for sealing against a drain opening with a central passage and a planar base, said planar base being fixedly attached to a solid, disc-like, annular member with an internal thread aligned with said central passage; and a water supply device having:

an elongated pipe with an externally threaded end for coupling with said internal thread in said sealing member;

a side arm integral with and extending at an upwardly disposed angle from said pipe at an end of said pipe remote from said sealing member, said arm being in communication with said pipe and having an externally threaded free end for coupling to a water hose; and a plunger valve having a hollow stem movably mounted in an end of said pipe remote from said sealing member, a knob fixedly attached at one end of said stem, a spring placed around said stem outside of said pipe for urging said stem out of said pipe when pressure is released from said knob, and a port in a wall of said stem for allowing water to flow through said side arm into said pipe when said plunger valve is depressed into said pipe.

4. A drain clearing device according to claims 1, 2 or 3 wherein said drain sealing member is made of rubber.

5. A drain clearing device according to claims 1, 2 or 3 wherein said water pipe is made of a material selected from the group consisting of plastics and metals.

6. A drain clearing device according to claims 1, 2 or 3 wherein said pipe is in the range of eight inches to twenty four inches in length.

7. A drain clearing device comprising:

a sealing member for sealing a drain opening, said member having a passage extending therethrough for a through flow of water;

an elongated pipe secured to said sealing member coaxially of said passage;

a side arm extending from and communicating with said pipe at a point remote from said sealing member to supply water to said pipe; and a plunger valve in said pipe at an end remote from said sealing member to selectively communicate said side arm with said pipe for passage of a pressurized flow of water from said side arm into said pipe.

* * * * *